US005647013A

United States Patent [19]

Salvage et al.

[11] Patent Number: 5,647,013

[45] Date of Patent: Jul. 8, 1997

[54] ELECTROACOSTIC TRANSDUCER

[75] Inventors: Richard James Salvage, Burgess Hill; Steven John Harrington, Steyning, both of United Kingdom

[73] Assignee: Knowles Electronics Co., West Sussex, United Kingdom

[21] Appl. No.: 416,887

[22] PCT Filed: Oct. 15, 1993

[86] PCT No.: PCT/GB93/02140

§ 371 Date: Jun. 2, 1995

§ 102(e) Date: Jun. 2, 1995

[87] PCT Pub. No.: WO94/10817

PCT Pub. Date: May 11, 1994

[30] Foreign Application Priority Data

Oct. 29, 1992 [GB] United Kingdom ..... 9222677

[51] Int. Cl.[6] ..... H04R 25/00

[52] U.S. Cl. ..... 381/192; 381/68; 381/200

[58] Field of Search ..... 381/68, 68.6, 190, 381/192, 199, 200, 201, 68.2, 68.4

[56] References Cited

U.S. PATENT DOCUMENTS

| | | | |
|---|---|---|---|
| 3,005,880 | 10/1961 | Simshauser | 179/114 |
| 3,671,684 | 6/1972 | Tibbetts et al. | 179/117 |
| 3,836,733 | 9/1974 | Cragg | 179/119 A |
| 3,885,553 | 5/1975 | Vecchio | 128/24.1 |
| 3,935,398 | 1/1976 | Carlson et al. | 179/114 A |
| 4,272,654 | 6/1981 | Carlson | 179/119 A |
| 5,193,116 | 3/1993 | Mostardo | 381/68 |
| 5,299,176 | 3/1994 | Tibbetts | 381/199 |
| B1 4,473,722 | 6/1995 | Wilton | 381/200 |

FOREIGN PATENT DOCUMENTS 2085694 4/1982 United Kingdom .

*Primary Examiner*—Curtis Kuntz
*Assistant Examiner*—Rexford N. Barnie
*Attorney, Agent, or Firm*—Wallenstein & Wagner, Ltd.

[57] ABSTRACT

This invention relates to electroacoustic transducers of the type which incorporate a reed armature. Thus a transducer 10 comprises a coil 12, magnets 13,14, pole pieces 15,16 and a reed armature 17, which passes through a central tunnel 18 defined the coil. A central portion 19 of the reed 17 lies within the tunnel and has opposed formation 20,21 which limit the possible deflection of the reed 17. Other deflection limiting arrangements are described.

16 Claims, 4 Drawing Sheets

ELECTROACOSTIC TRANSDUCER

This invention relates to electroacoustic transducers of the type which incorporate a reed armature.

An electroacoustic transducer of this general type is described in our British Patent 2095510, and typically includes a pair of spaced permanent magnets, a coil having a tunnel therethrough and a reed armature having a central portion which extends through the coil and a tip portion which lies at least partially between the magnets. The arrangement is such that when the moving part of the reed shifts in one direction or another away from a centralised position between the two poles, the magnetic flux is caused to flow in one direction or the other along the reed and hence through the coil. The reed is attached to a diaphragm and in this way the vibrations of the diaphragm caused by received sound are converted into corresponding currents in the coil or vice versa. It is very easy to damage the reed by over deflection, if the transducer experiences a shock e.g. from being dropped. In addition the tip portion may strike the magnet with considerable force. It will be understood that a similar configuration can be used for a receiver or loudspeaker.

In one transducer the coil tunnel has a restricted central portion which limits the degree of deflection available to the reed and hence reduces the possible damage. However because coils in such transducer are almost always formerless, this solution would apparently only be available when the coil is set in epoxy having been wound on a flexible removable plastic former. This method of construction is only appropriate for certain types of transducer and has a number of limitations.

From one aspect the present invention consists in an electroacoustic transducer including a pair of spaced permanent magnets, a coil having a tunnel therethrough and a reed armature having a central portion which extends through the coil and a tip portion which lies at least partially between the magnets, the reed being mounted for deflection towards or away from the respective magnets, wherein the central portion and/or the tip of the reed is provided with a formation and/or a restriction is provided between the coil and the magnets, or at the magnet end of the tunnel, for limiting the available deflection of the reed.

In a particularly preferred embodiment there may be formations on each side of the reed and the formation or formations may be deformations in the reed. The formations are preferably on the central portion to reduce distortion of the magnetic field. Where the reed is flat and elongate, the formations are preferably formed by pressing out sections of the reed at or adjacent the longitudinal axis of the reed. By pressing, or otherwise deforming, the formation or formations from the reed, the limitation on the movement of the reed can be achieved without adding any mass to the reed, or indeed the transducer as a whole. However by restricting the formation or formations to the area of the central axis of the reed, no additional restriction on the lateral position of the reed within the tunnel is introduced and extra restrictions on its rotational positions are limited. Further such formations can be pressed with considerable accuracy, which is important when the dimensions and tolerances involved are extremely small as is the case where the transducer is for use in a hearing aid.

In this construction the formation or formations may be semi-spherical, ridges or star shapes or a combination thereof.

In another arrangement the formation or formations may be constituted by a body or bodies mounted on the reed. For example the body may be in the form of a sleeve or may be in the form of some settable or deposited material or may simply be a body attached to the reed. These arrangements are somewhat less preferred, because they add weight to the reed and in the latter case the control of dimensions is more difficult. However, in certain cases, there may be advantages where the localised deformation of the reed undesirably affects its flexing properties.

In an alternative arrangement a restriction may be provided at or adjacent the end of the tunnel either by means of a spacer between the magnets and the coil with the restricted opening therein or in the form of an insert which can be pressed into the magnet end of the tunnel. In either case it is preferred that the restriction is constructed only to engage an area close to or adjacent the longitudinal axis of the reed.

From another aspect the invention consists in an electroacoustic transducer including a pair of spaced permanent magnets, a coil having a tunnel therethrough and a flat elongate reed armature having a central portion which extends through the coil tunnel and a tip portion which lies at least partially between the magnets, the reed being mounted for deflection towards or away from the respective magnets, wherein the tunnel is defined solely by the windings of the coil and at least one part of the cross-section of the tunnel is dimensioned or shaped to restrict movement of the reed in a direction orthogonal to its plane.

The part may thus be narrower than the rest of the tunnel in the direction of reed movement or the tunnel may be formed with a formation or formations for engaging a part of the reed before the tunnel wall would otherwise be engaged by the reed. Preferably the formation or formations are in this case non-reentrant to avoid problems in winding the coil. For example the formations may cut off the corners of an otherwise rectangular cross-sectioned tunnel.

Although the invention has been defined above it is to be understood that it includes any inventive combination of the features set out above or in the following description.

The invention may be performed in various ways and specific embodiments will now be described in reference to the accompanying drawings, in which.

Figure 1:
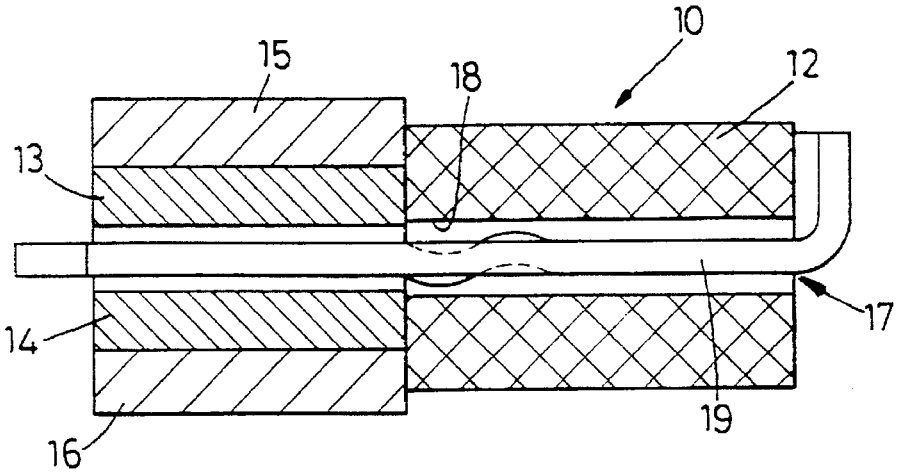
FIG. 1 is a cross sectional stylised view through an electroacoustic transducer with the reed in its central position.
Figure 2:
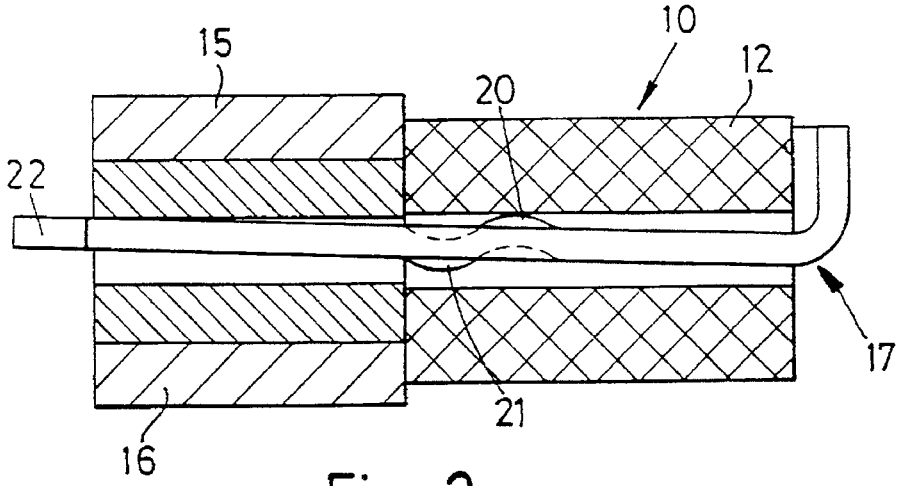
FIG. 2 shows the reed in its extreme upward position.
Figure 3:
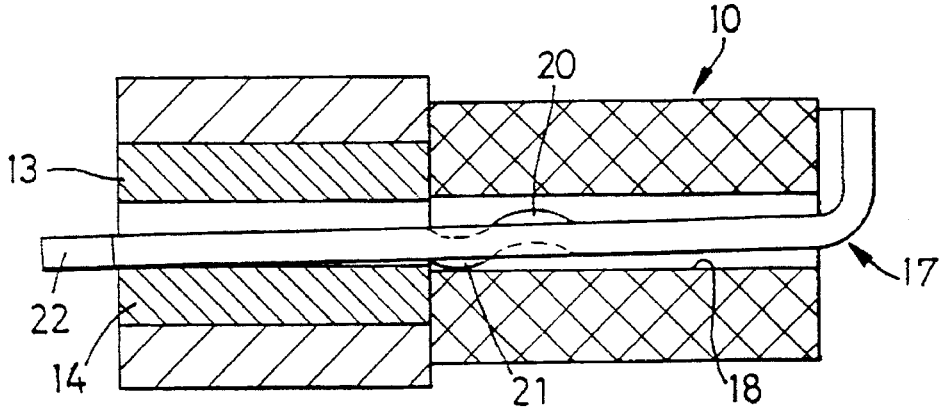
FIG. 3 shows the reed in its extreme downward position.
Figure 4:
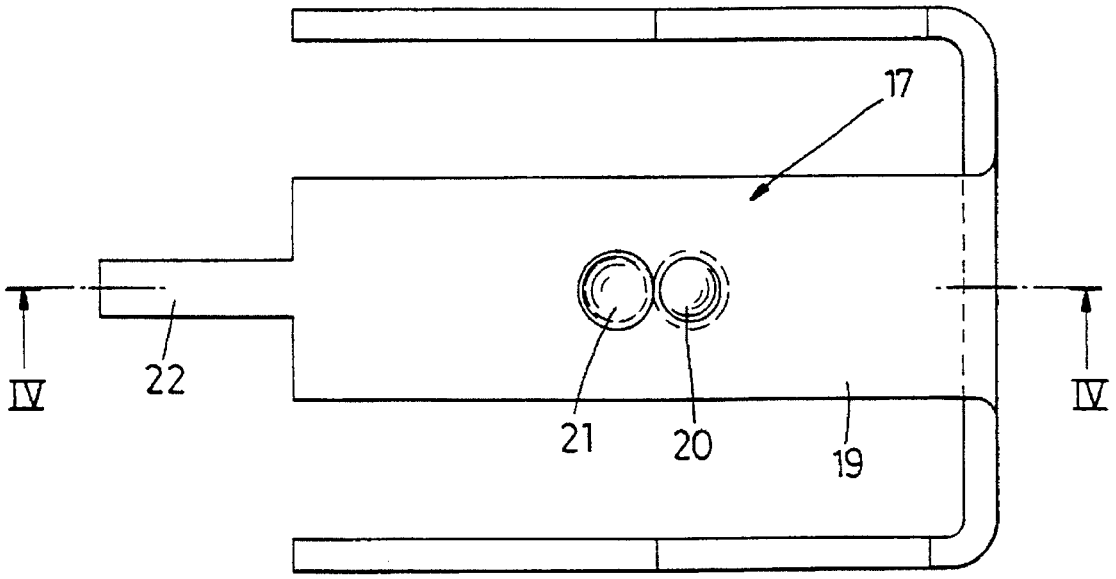
FIG. 4 is a view from above of the reed of the transducers FIGS. 1 to 3.
Figure 5:
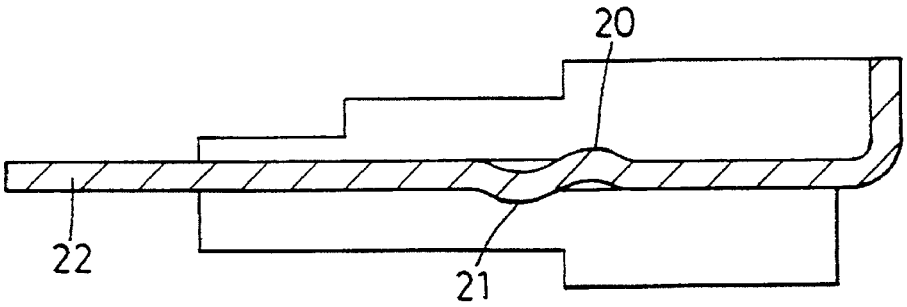
FIG. 5 is a cross sectional view of the reed of FIG. 4 along the line of IV—IV.

An electroacoustic transducer 10 is schematically shown in FIGS. 1 to 3 and comprises a coil 12, magnets 13,14, pole pieces 15,16 and reed armature 17. As can be seen in FIG. 1 the coil 12 defines a central tunnel 18 and the magnets 13,14 are spaced apart. The reed armature 17 extends along the tunnel 18 and between the magnets 13,14. A central portion 19 of the reed 17 lies within the tunnel 18 and, adjacent one end of that central portion 19, are formed opposed formations 20,21. As can be best seen in FIGS. 4 and 5 the formations 20,21 are generally semi-spherical and are pressed out of the plane of the reed.

As can be seen in FIGS. 2 and 3 the formations 20,21 respectively engage the coil 12 when the reed is deflected upwardly or downwardly beyond its normal working range.

Preferably the formations are sized to prevent the tip 22 of the reed 17 striking the magnets 13,14, but considerable protection can also be provided if they are dimensioned so that they strike the coil 12, before the tip 22 strikes either the magnet 13 or magnet 14.

It has been discovered that a transducer constructed in this manner can be dropped from, typically, twice the height, without incurring damage to the reed, as compared with an identical transducer without the formations. Put another way this means it can, typically, receive up to 4 times the shock without damage.

It will be appreciated that the formations could have other conventional shapes, but they are confined to the general area of the longitudinal axis of the reed 17 so that their existence introduces as little restriction as possible on the rotational or lateral position of the reed 17 within the tunnel 18. In a construction where this was not a factor, the formations could be at the sides of the reed 17 or extend right across it.

As has been explained above this construction has particular advantages; for example no extra mass is added to the reed 17. However many of the advantages of the invention can be obtained with other arrangements and these are briefly described in connection with FIGS. 6 to 9.

Figure 6:
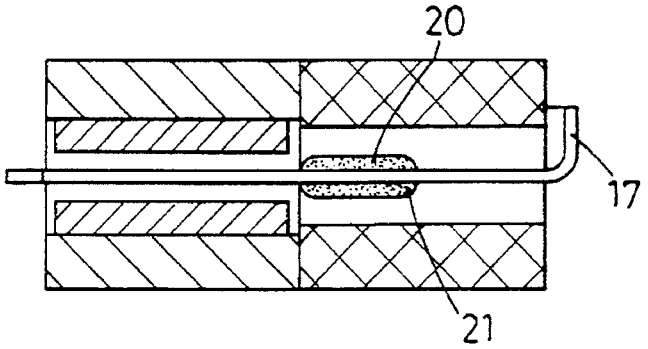
FIGS. 6 to 9 are schematic views generally corresponding to FIG. 1 showing alternative arrangements.
Figure 7:
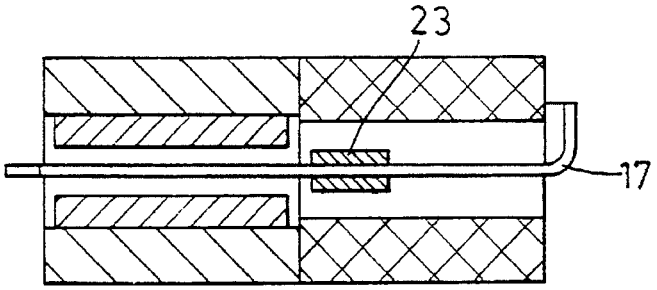

In FIG. 6 the formations 20,21 are formed by blobs of adhesive or other settable material. In FIG. 7 the formations 20,21 are formed by a sleeve 23 slid onto the reed 17.

Figure 8:
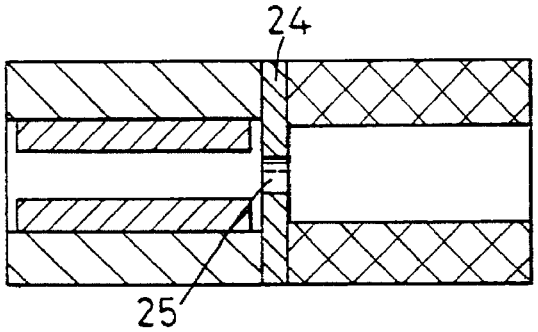
Figure 9:
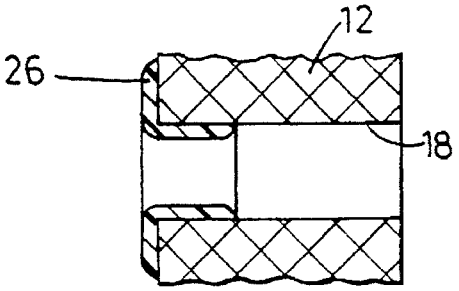

FIGS. 8 and 9 show an another approach in which a restriction is introduced either between the magnets 13,14 or the coil 12 or at the magnet end of the tunnel 18, so that the restriction engages the reed 17 to limit the deflection in a similar manner to that achieved by the formations mentioned above. Thus in FIG. 8 a spacer 24 has a restricted opening 25 whilst in FIG. 9 an insert 26 is pressed into the end of the tunnel 18 or created using settable plastic material. Preferably the restriction so created is confined to the area of the longitudinal axis for the reasons mentioned above.

Figure 10:
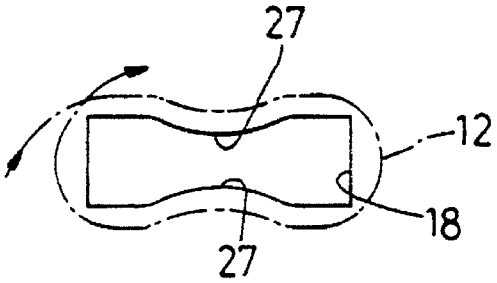
FIGS. 10 to 12 show a number of tunnel cross-sections for use in an alternative form of the invention.
Figure 11:
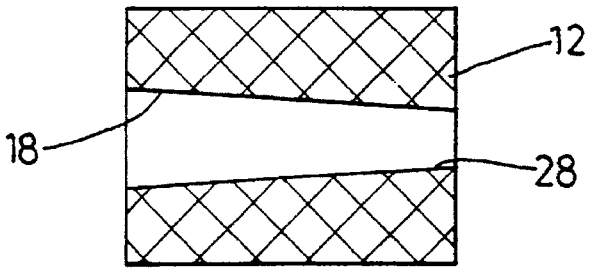
Figure 12:
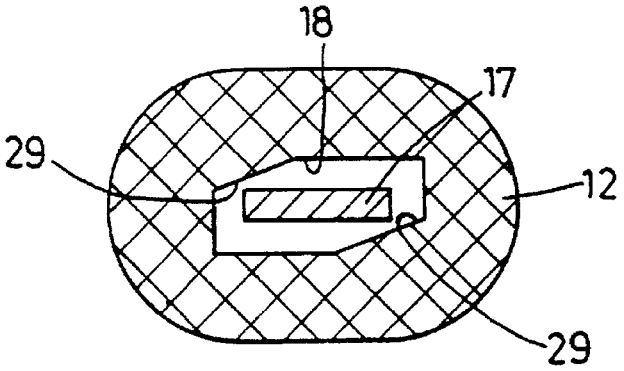

A further approach is illustrated in FIGS. 10 to 12 in which the coil 12, which has its tunnel 18 defined purely by its windings, is wound in such a way that at least one part of its cross-section the tunnel walls are formed to engage the reed 17 in a way which reduces damaging deflections of the reed.

Thus in FIG. 10 the coil 12 is wound with projections 27 projecting into the tunnel 18; in FIG. 11, which is a longitudinal section of the coil 12, the tunnel has a reduced cross-section at 28 and in FIG. 12 the corners of the rectangular tunnel 18 are cut off to provide inclined reed engaging surfaces 29.

It will be understood that the restriction principles recited in this description are applicable to many other reed mountings and configurations.

We claim:

1. An electroacoustic transducer including a pair of spaced permanent magnets, a coil having a tunnel therethrough and a reed armature having a central portion which extends through the coil and a tip portion which lies at least partially between the magnets, the reed being mounted for deflection towards or away from the respective magnets, wherein the central portion of the reed directly includes a formation on opposite sides thereof for limiting the available deflection of the reed.

2. A transducer as claimed in claim 1, wherein the formations are opposed deformations in the reed.

3. A transducer as claimed in claim 2, wherein the reed is flat and elongate and the formations are formed at or adjacent the longitudinal axis of the reed.

4. A transducer as claimed in claim 3, wherein the formations are pressed out of the plane of the reed.

5. A transducer as claimed in any one of claims 1 to 4, wherein the formations are semi-spherical, ridges or star shaped or a combination thereof.

6. A transducer as claimed in any one of claims 1 to 3, wherein the formations are constituted by a body or bodies mounted on the reed.

7. A transducer as claimed in claim 6, wherein the body is in the form of a sleeve mounted on the reed.

8. A transducer as claimed in claim 7, wherein the body is in the form of a lump of settable material deposited on the reed.

9. An electroacoustic transducer including a pair of spaced permanent magnets, a coil having a tunnel therethrough and a flat elongate reed armature having a central portion which extends through the coil tunnel and a tip portion which lies at least partially between the magnets, the reed being mounted for deflection towards or away from the respective magnets, wherein the tunnel is formed solely by the windings of the coil and at least one part of the cross-section of the tunnel is dimensioned or shaped to restrict movement of the reed in a direction orthogonal to its plane.

10. A transducer as claimed in claim 9 wherein the part is narrower than the rest of the tunnel in the direction of reed movement.

11. A transducer as claimed in claim 9 wherein the tunnel is formed with a formation or formations for engaging a part of the reed before the tunnel wall would otherwise be engaged by the reed.

12. A transducer as claimed in claim 11 wherein the formations are non-reentrant.

13. A transducer as claimed in claim 12 wherein the formations cut off the corners of an otherwise rectangular cross-section tunnel.

14. An electroacoustic transducer including a pair of spaced permanent magnets, a coil having a tunnel therethrough and a reed armature having a central portion which extends through the coil and a tip portion which lies at least partially between the magnets, the reed being mounted for deflection towards or away from the respective magnets, wherein a restriction is provided between the coil and the magnet for limiting the available deflection of the reed.

15. A transducer as claimed in claim 14, wherein the restriction is constituted by an aperture defined in a spacer located between the coil and the magnets, the dimension of the aperture, the direction of deflection of the reed, being smaller than the corresponding dimension of the tunnel.

16. A transducer as claimed in claim 14, wherein the reed is elongate and the restriction is constructed to engage only area on or adjacent the longitudinal axis of the reed.

* * * * *

US005647013C1

(12) REEXAMINATION CERTIFICATE (4344th)

United States Patent

Salvage et al.

(10) Number: US 5,647,013 C1

(45) Certificate Issued: May 8, 2001

(54) ELECTROACOUSTIC TRANSDUCER

(75) Inventors: Richard James Salvage, Burgess Hill; Steven John Harrington, Steyning, both of (GB)

(73) Assignee: Knowles Electronics Co., Burgess Hill (GB)

Reexamination Request:
No. 90/005,609, Jan. 11, 2000

Reexamination Certificate for:

| | |
|---|---|
| Patent No.: | **5,647,013** |
| Issued: | **Jul. 8, 1997** |
| Appl. No.: | **08/416,887** |
| Filed: | **Jun. 2, 1995** |

(22) PCT Filed: Oct. 15, 1993

(86) PCT No.: PCT/GB93/02140

§ 371 Date: Jun. 2, 1995

§ 102(e) Date: Jun. 2, 1995

(87) PCT Pub. No.: WO94/10817

PCT Pub. Date: May 11, 1994

(30) Foreign Application Priority Data

Oct. 29, 1992 (GB) ..... 9222677

(51) Int. Cl.[7] ..... H04R 1/00; H04R 9/06

(52) U.S. Cl. ..... 381/396; 381/324; 381/312; 381/417

(58) Field of Search ..... 381/312, 324, 381/328, 330, 325, 322

(56) References Cited

U.S. PATENT DOCUMENTS

| | | | |
|---|---|---|---|
| Re. 33,718 | 10/1991 | Carlson | 367/181 |
| 2,143,097 | 1/1939 | Warnke | 179/119 |
| 2,678,360 | 5/1954 | Bellis | 200/91 |
| 2,794,862 | 6/1957 | Tøpholm | 179/114 |
| 2,848,579 | 8/1958 | Russell | 200/93 |
| 2,912,523 | 11/1959 | Knowles et al. | 179/108 |
| 2,916,700 | 12/1959 | Daschke | 324/80 |
| 2,994,016 | 7/1961 | Tibbetts et al. | 317/172 |
| 2,998,804 | 9/1961 | Clement | 121/41 |
| 3,002,058 | 9/1961 | Knowles | 179/114 |
| 3,005,880 | 10/1961 | Simshauser | 179/114 |
| 3,076,062 | 1/1963 | Fener | 179/119 |
| 3,111,563 | 11/1963 | Carlson | 179/114 |
| 3,154,172 | 10/1964 | Tibbetts | 181/32 |
| 3,163,723 | 12/1964 | Tibbetts | 179/180 |
| 3,172,022 | 3/1965 | Tibbetts | 317/173 |
| 3,177,412 | 4/1965 | Carlson | 317/173 |
| 3,182,384 | 5/1965 | Carlson et al. | 29/155.57 |
| 3,249,702 | 5/1966 | Carlson | 179/115 |
| 3,251,954 | 5/1966 | Carlson | 179/115 |
| 3,347,991 | 10/1967 | Carlson | 179/114 |
| 3,413,424 | 11/1968 | Carlson | 179/115 |
| 3,432,622 | 3/1969 | Sebesta et al. | 179/115 |
| 3,491,436 | 1/1970 | Carlson | 29/594 |
| 3,531,745 | 9/1970 | Tibbetts | 335/231 |
| 3,560,667 | 2/1971 | Carlson | 179/114 |

(List continued on next page.)

FOREIGN PATENT DOCUMENTS

| | | |
|---|---|---|
| 1 044 169 | 11/1958 | (DE) . |
| 1 146 542 | 4/1963 | (DE) . |
| 0 065 746 A2 | 12/1982 | (EP) . |
| 0 094 992 B1 | 11/1983 | (EP) . |
| 0 499 237 A2 | 8/1992 | (EP) . |
| 564 941 | 4/1923 | (FR) . |
| 551 182 | 5/1923 | (FR) . |
| 2 085 694 | 4/1982 | (GB) . |
| 2 229 339 | 9/1990 | (GB) . |
| 523157 | 4/1955 | (IT) . |

*Primary Examiner*—Curtis Kuntz

(57) ABSTRACT

This invention relates to electroacoustic transducers of the type which incorporate a reed armature. Thus a transducer 10 comprises a coil 12, magnets 13,14, pole pieces 15,16 and a reed armature 17, which passes through a central tunnel 18 defined the coil. A central portion 19 of the reed 17 lies within the tunnel and has opposed formation 20,21 which limit the possible deflection of the reed 17. Other deflection limiting arrangements are described.

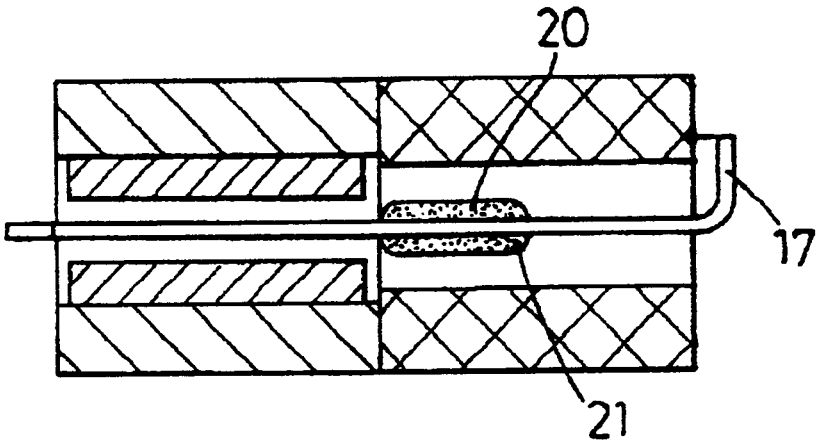

U.S. PATENT DOCUMENTS

| | | | |
|---|---|---|---|
| 3,573,397 | 4/1971 | Sawyer et al. | 179/115 |
| 3,577,020 | 5/1971 | Carlson et al. | 310/8.2 |
| 3,588,383 | 6/1971 | Carlson et al. | 179/119 A |
| 3,617,653 | 11/1971 | Tibbetts et al. | 179/114 A |
| 3,671,684 | 6/1972 | Tibbetts et al. | 179/117 |
| 3,701,865 | 10/1972 | Carlson et al. | 179/181 R |
| 3,740,496 | 6/1973 | Carlson et al. | 179/111 E |
| 3,742,156 | 6/1973 | Broersma | 179/119 A |
| 3,766,332 | 10/1973 | Carlson et al. | 179/114 A |
| 3,770,911 | 11/1973 | Knowles et al. | 179/107 S |
| 3,836,733 | 9/1974 | Cragg | 179/119 A |
| 3,885,553 | 5/1975 | Vecchio | 128/24.1 |
| 3,930,560 | 1/1976 | Carlson et al. | 181/160 |
| 3,935,398 | 1/1976 | Carlson et al. | 179/114 A |
| 3,979,566 | 9/1976 | Willy | 179/115.5 ES |
| 4,000,381 | 12/1976 | Plice et al. | 179/114 M |
| 4,006,321 | 2/1977 | Carlson | 179/180 |
| 4,015,227 | 3/1977 | Riko et al. | 335/231 |
| 4,031,287 | 6/1977 | Suzuki et al. | 428/379 |
| 4,063,050 | 12/1977 | Carlson et al. | 179/111 E |
| 4,109,116 | 8/1978 | Victoreen | 179/107 |
| 4,189,627 | 2/1980 | Flanagan | 179/180 |
| 4,272,654 | 6/1981 | Carlson | 179/119 A |
| 4,360,711 | 11/1982 | Steiner | 179/115 R |
| 4,410,769 | 10/1983 | Tibbetts | 179/119 A |
| 4,425,482 | 1/1984 | Bordelon et al. | 179/120 |
| 4,447,677 | 5/1984 | Miyahra et al. | 179/107 |
| 4,450,930 | 5/1984 | Killion | 181/158 |
| 4,473,722 | 9/1984 | Wilton | 179/114 A |
| 4,509,193 | 4/1985 | Carlson | 381/113 |
| 4,518,831 | 5/1985 | Stanley et al. | 179/119 |
| 4,592,087 | 5/1986 | Killion | 381/68 |
| 4,628,907 | 12/1986 | Epley | 128/1.6 |
| 4,689,819 | 8/1987 | Killion | 381/68 |
| 4,728,934 | 3/1988 | Pfander et al. | 340/407 |
| 4,730,283 | 3/1988 | Carlson et al. | 367/181 |
| 4,800,982 | 1/1989 | Carlson | 181/130 |
| 4,807,294 | 2/1989 | Iwata et al. | 381/190 |
| 4,807,612 | 2/1989 | Carlson | 128/868 |
| 4,815,138 | 3/1989 | Diethelm | 381/69.2 |
| 4,837,544 | 6/1989 | McDougal | 336/185 |
| 4,837,833 | 6/1989 | Madaffari | 381/69 |
| 4,867,267 | 9/1989 | Carlson | 181/130 |
| 4,870,688 | 9/1989 | Voroba et al. | 381/60 |
| 4,944,017 | 7/1990 | Cognasse et al. | 381/79 |
| 4,956,868 | 9/1990 | Carlson | 381/189 |
| 5,004,647 | 4/1991 | Shah | 428/349 |
| 5,068,901 | 11/1991 | Carlson | 381/68.6 |
| 5,101,435 | 3/1992 | Carlson | 381/68.6 |
| 5,193,116 | 3/1993 | Mostardo | 381/69 |
| 5,219,658 | 6/1993 | Ueoka | 428/383 |
| 5,255,246 | 10/1993 | van Halteren | 367/170 |
| 5,299,176 | 3/1994 | Tibbetts | 367/175 |
| 5,335,286 | 8/1994 | Carlson et al. | 381/191 |
| 5,610,989 | 3/1997 | Salvage et al. | 381/69 |
| B1 4,473,722 | 6/1995 | Wilton | 381/200 |

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–16 is confirmed.

* * * * *